US011946730B2

(12) United States Patent
Teeter

(10) Patent No.: US 11,946,730 B2
(45) Date of Patent: Apr. 2, 2024

(54) SELF-EJECTING MUZZLELOADER SAFETY CARTRIDGE

(71) Applicant: Joe D. Teeter, Gold Hill, NC (US)

(72) Inventor: Joe D. Teeter, Gold Hill, NC (US)

( * ) Notice: Subject to any disclaimer, the term of this patent is extended or adjusted under 35 U.S.C. 154(b) by 0 days.

(21) Appl. No.: 18/084,133

(22) Filed: Dec. 19, 2022

(65) Prior Publication Data

US 2023/0243627 A1 Aug. 3, 2023

Related U.S. Application Data

(60) Provisional application No. 63/404,196, filed on Sep. 7, 2022, provisional application No. 63/305,719, filed on Feb. 2, 2022.

(51) Int. Cl.
*F42B 5/38* (2006.01)
*F41C 9/08* (2006.01)

(52) U.S. Cl.
CPC ..... *F42B 5/38* (2013.01); *F41C 9/085* (2013.01)

(58) Field of Classification Search
CPC ..... F42B 5/38; F41C 9/08; F41C 9/085
See application file for complete search history.

(56) References Cited

U.S. PATENT DOCUMENTS 26,337 A * 12/1859 Cochran ..... F42B 14/02 102/524
41,684 A * 2/1864 Conover ..... F42B 5/18 102/431
2,466,561 A * 4/1949 Standal ..... F42B 5/38 229/5.5
3,008,412 A * 11/1961 Merdinyan ..... F42B 5/38 102/437
3,139,827 A * 7/1964 Orozco ..... F42B 7/04 102/449
5,094,024 A * 3/1992 Duke ..... F41C 9/085 42/90
5,164,539 A * 11/1992 French ..... F42B 14/064 102/520
5,726,378 A * 3/1998 Barrett ..... C06B 45/00 102/431
6,085,454 A * 7/2000 Caudle ..... F42B 14/06 42/51
8,387,537 B2 * 3/2013 Brus ..... F42B 5/18 102/431
2004/0182274 A1 * 9/2004 Bond ..... F41C 9/085 42/51
2012/0318123 A1 * 12/2012 Worrell ..... F42B 5/38 102/431
2014/0090285 A1 * 4/2014 Peterson ..... F41C 9/085 42/51

FOREIGN PATENT DOCUMENTS

DE 2606135 A1 * 8/1977

* cited by examiner

*Primary Examiner* — Gabriel J. Klein
(74) *Attorney, Agent, or Firm* — Bennet K. Langlotz; Langlotz Patent & Trademark Works, LLC

(57) ABSTRACT

A muzzleloader cartridge comprises a case having an open rear end, a forward end defining a vent hole, and sidewall defining a plurality of perforations. The case defines an interior space with a combustible liner lining the interior space; a first propellant received in the interior space; and a second propellent having a different characteristic received in the interior space rearward of the first propellent.

1 Claim, 8 Drawing Sheets

SELF-EJECTING MUZZLELOADER SAFETY CARTRIDGE

CROSS-REFERENCE TO RELATED APPLICATIONS

This application claims the benefit of U.S. Provisional Patent Application No. 63/305,719, filed on Feb. 2, 2022, entitled "SELF-EJECTING MUZZLELOADER SAFETY CARTRIDGE", and of U.S. Provisional Patent Application No. 63/404,196, filed on Sep. 7, 2022, entitled "SELF-EJECTING MUZZLELOADER SAFETY CARTRIDGE", which is hereby incorporated by reference in its entirety for all that is taught and disclosed therein.

FIELD OF THE INVENTION

The present invention relates to safety cartridges.

BACKGROUND AND SUMMARY

We have often been told smokeless powder will cause a muzzleloader to explode.

Using a powder with the wrong burn rate, and or using the wrong amount of powder will cause a barrel to explode.

The above disadvantage is addressed by a muzzleloader cartridge comprises a case having an open rear end, a forward end defining a vent hole, and sidewall defining a plurality of perforations. The case defines an interior space with a combustible liner lining the interior space; a first propellant received in the interior space; and a second propellent having a different characteristic received in the interior space rearward of the first propellent.

BRIEF DESCRIPTION OF THE DRAWINGS

Drawings 1, 2, 3, 4 and 5 reveal the construction and overall mechanism of how the cartridge operates. When the hot gases from a fired 209 primer tear through the bottom layer of tissue paper the fast-burning initiator propellant begin the reaction. This then ignites the thin nitrocellulose separator disk which separates the initiator from the main propellant charge, which is a slower burning rifle propellant. In the past some muzzleloader users have described this as a "Duplex" load. Some users have added a few grains of fast burning pistol powder into the barrel first. This powder often ignites more easily than rifle propellants. They would then add their slower burning rifle propellant on top of the small amount of pistol powder. My invention works in a similar manner but offers the advantage of keeping the two propellants separated by a thin disk of nitrocellulose paper, into separate sections of the cartridge.

The holes in the sides of the cartridge allow the hot gases produced by the burning propellant to leave the sides of the cartridge and equalize the pressure within the barrel at this location when the Nitrocellulose paper in the internal paper tube is consumed. The internal paper tube keeps the propellant from leaking out of the holes in the cartridge before ignition. It operates in a manner like the perforated section of a 105 mm Recoil-less rifle cartridge. Therefore, this section of the cartridge can be made up of thin metal or even polymers because it does not have to be a pressure vessel.

Figure 1:
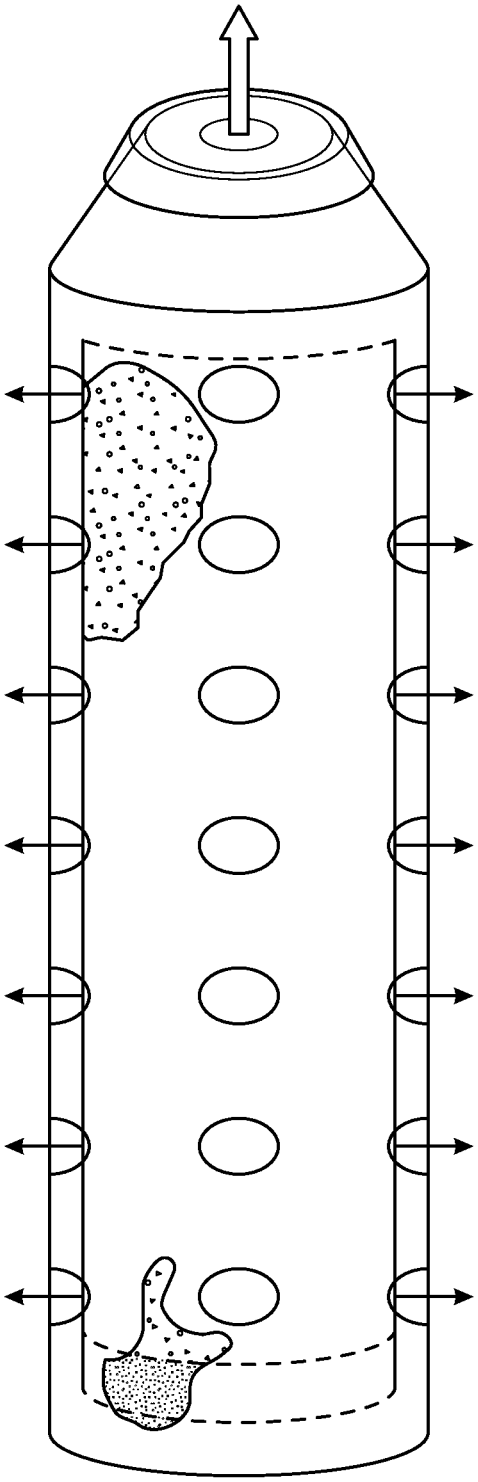
Figure 2:
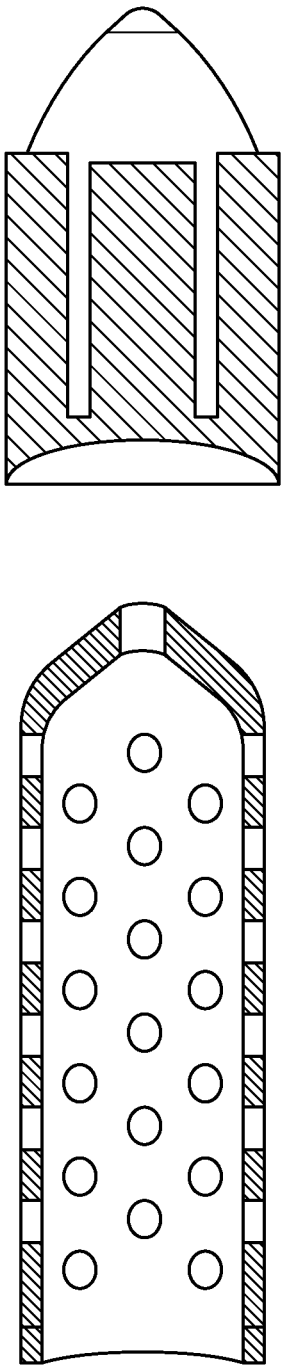
Figure 3:
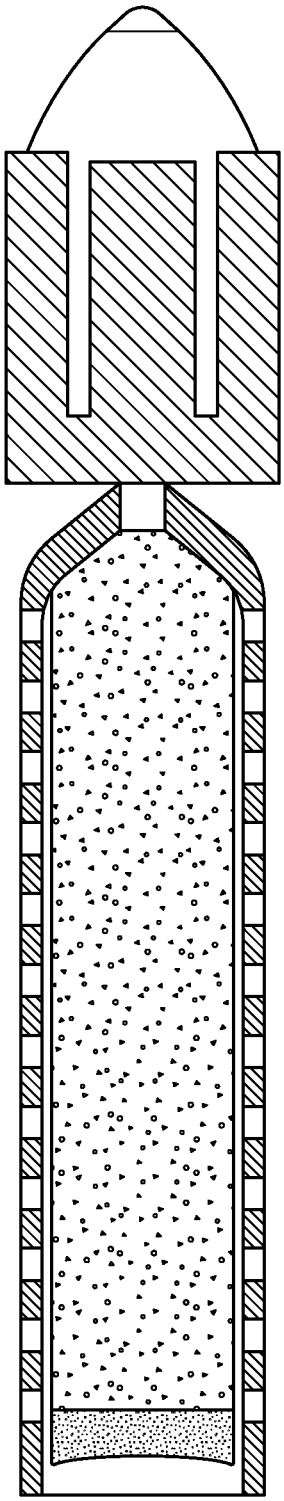
Figure 4:
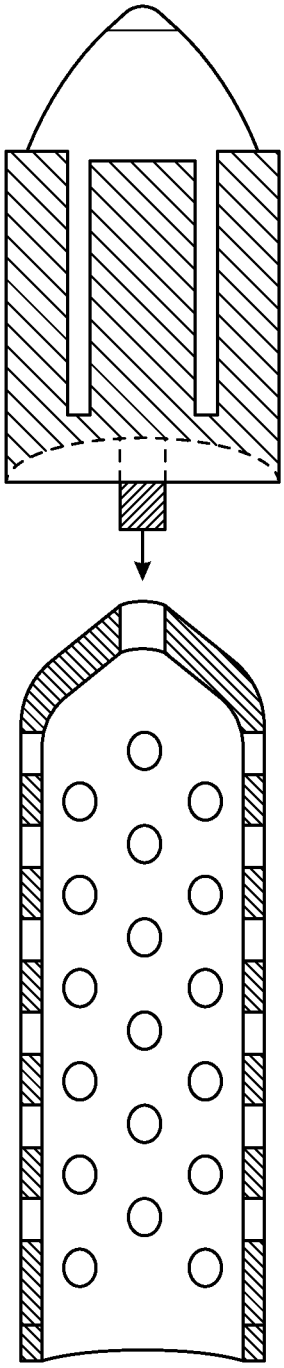
Figure 5:
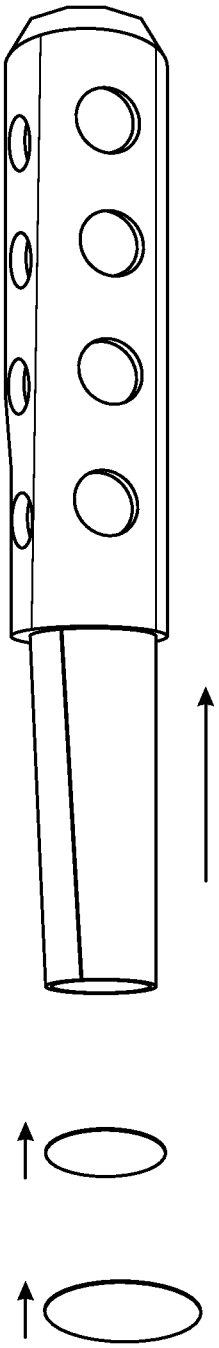
Figure 6:
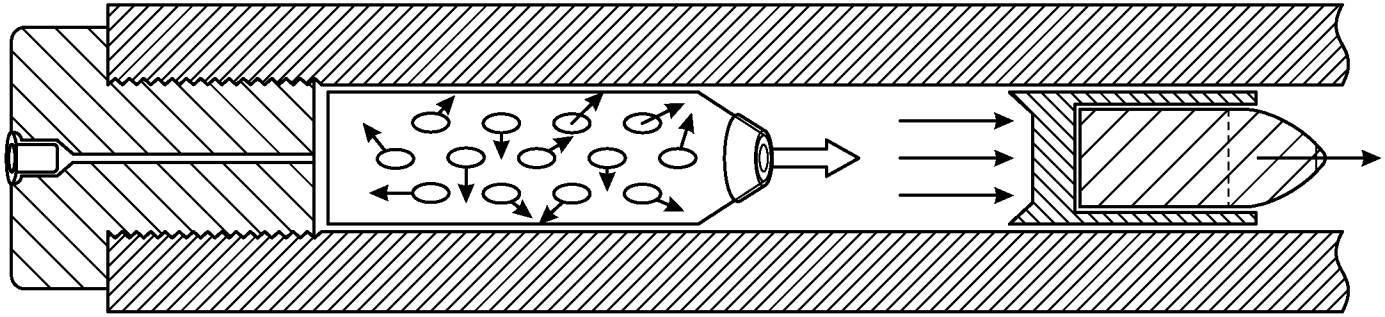
Figure 7:
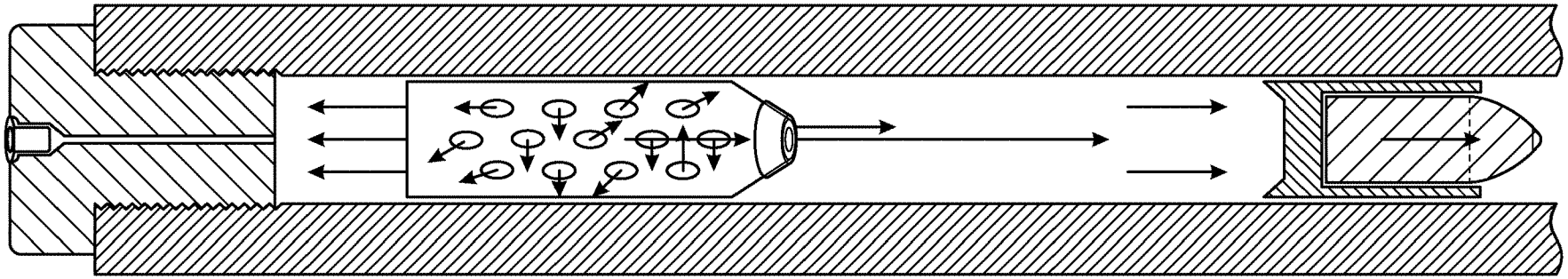
Figure 8:
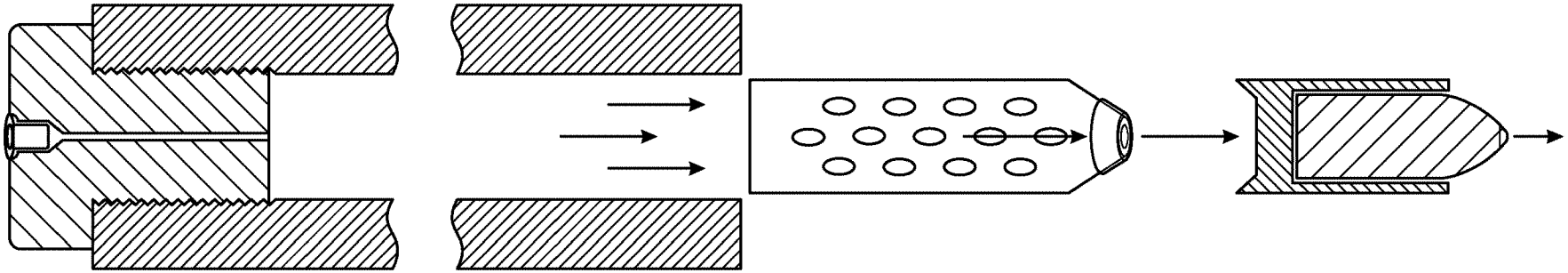

The cone shaped top with center hole at the end of the cartridge provides a constriction which will allow high pressure gas to the sabot containing the bullet but offers enough resistance to eject the cartridge. This is a unique property of this invention. It also allows the sabot to act independently of the cartridge ensuring the accuracy of the bullet inside the sabot.

Because this cartridge is made up of either a stiff metal or polymer there is no danger in the person crushing the cartridge when the sabot and bullet are loaded on top of the cartridge. It will also allow those using inline muzzleloaders to unscrew their breech plug and remove the cartridge at the end of the day's hunting. This can be another tremendous safety advantage to this invention which is similar to that now offered by the FireStick cartridge. However, this cartridge would work in many thousands of rifles which cannot use the FireStick.

The other tremendous advantage is the lack of barrel corrosion produced by corrosive oxidizers found in Blackpowder and the Blackpowder substitutes. When matched with the appropriate weight of bullet, this cartridge can use purely Nitrocellulose based propellants with almost zero corrosion.

This cartridge also takes the guess work out of estimating how much propellant to use with a given weight of bullet. It will be prepackaged by those who know how to match the correct propellant and bullet. In the same way conventional breechloading cartridges are used, a hunter can load and shoot. There will be no more spilled powder when trying to get the propellant into the barrel.

It would also be possible to join the cartridge to the sabot/bullet by gluing the two together with hot glue. A sabot could be produced with a central stem that fit into the vent hole on the cone-shaped end of the cartridge. (See Drawing 4.) When the hot gases from the burning propellant pushed up through the vent hole it would melt the hot glue and separate the parts. This method has the advantage of connecting the cartridge and sabot/bullet into one piece. However, it has the disadvantage of not being able to unload the cartridge from the rifle at the end of the day's hunt because the tight-fitting sabot would be difficult to remove from the barrel.

Drawings 6, 7, and 8 show the action of the Self Ejecting Muzzleloader Safety Cartridge in the barrel, and its exit from the barrel.

DETAILED DESCRIPTION OF A PREFERRED EMBODIMENT

During 2019 a new muzzleloader produced by Traditions came to market. The "NitroFire" muzzleloader loads the bullet from the muzzle but loads the powder charge from the breech via a plastic cartridge, which is similar to a shotshell in many respects. The powder used in this "FireStick" cartridge claims to be "cleaner". Based on the product's MSD sheet, the propellant used is very similar to the formulation used in BlackHorn209 powder. This is a hybrid powder containing nitrocellulose and Guanidine Nitrate as the main oxidizers. The Guanidine Nitrate is corrosive.

When shotshells were first developed during the 19th century the propellant used was black powder. The loads were tailored to the older shotgun barrels. After smokeless powder came into use, some of the older guns like those using the Damascus Twist barrels could not handle the higher pressures. Many of those older shotguns became wall hangers as a result. However, shotshell manufacturers and shotgun manufacturers eventually agreed on pressure standards which now allow them to produce shotshells that will work in any modern shotgun. Why should modern muzzleloaders be any different?

Before the Savage 10ML muzzle loader was produced, I wrote a letter to Remington Arms Co. asking if it might be possible to produce a muzzleloader which used noncorrosive smokeless powder. The letter I received back from Remington listed the difficulties of making the idea work. Years later, Savage Arms solved those problems and produced the first commercially manufactured muzzleloader approved to use smokeless powder. Many thousands of shots have been safely fired in the Savage rifles with smokeless powder. However, some of the barrels have ruptured due to human error. I now use the proper load of specific smokeless powders in all of my muzzleloaders, including the factory Remington ML, and the Remington UML. It is unfortunate that Remington went into bankruptcy and has now been re-organized into a new company.

We have often been told smokeless powder will cause a muzzleloader to explode. Using a powder with the wrong burn rate, and or using the wrong amount of powder will cause a barrel to explode. However, Savage Arms has proven smokeless powders can also be safely used in a muzzleloader.

A number of years ago, a new muzzleloader propellant came into the marketplace under the name of "BlackHorn 209". It was approved for use in all muzzleloaders. However, the cleaning solvent used for this propellant is not the same water-based products used with Blackpowder, Pyrodex, and the other substitutes. The MSD sheet for BlackHorn 209 reveals why. The word "esters" is found on the sheet. This reveals a secret about the propellent. Nitrocellulose, which is the base of smokeless powders, is an ester. Therefore, we know BlackHorn 209 is actually a hybrid powder made up of smokeless powder and Guanidine Nitrate as the main oxidizers. Once again, we have proof that the proper type of smokeless powder will work in a muzzleloader.

How can we remove the human error from muzzleloaders and use modern noncorrosive smokeless powders? We need a cartridge which will contain a premeasured volume of the proper smokeless powder. During the Civil War paper cartridges were produced which contained the bullet and the proper amount of Blackpowder propellant. These were produced for the 58 caliber Springfield rifles, and also for the later Sharps breechloaders. Can a modern cartridge for muzzleloading rifles be produced using modern materials?

During the last few months, I have developed a modern muzzleloader cartridge which will allow shooters to safely use smokeless powder in modern muzzleloaders. The Traditions FireStick cartridge only works in the NitroFire muzzleloader. There is a tremendous market for those muzzleloaders which cannot use the FireStick. In the same way that shotshell manufacturers and shotgun manufacturers have adopted pressure standards, a muzzleloading cartridge loaded with a smokeless powder of the correct burn rate and mass can achieve a similar goal. Based on my email correspondence with Traditions, their standard of pressure for the muzzle loader barrels made by that company is 25,000 psi.

The cartridge I recently developed combines some aspects of the 105 mm Recoilless Rifle cartridge, and the paper cartridges used during the Civil War, along with modern materials. This perforated cartridge contains an internal tube made up of a thin layer of paper which contains the smokeless propellant. If nitrocellulose paper is used as the internal cartridge tube it will be completely consumed during ignition. The older paper cartridges were often saturated with Potassium Nitrate.

However, this chemical is highly corrosive and should be avoided. Modern nitrocellulose paper avoids this problem. The new cartridge also self-ejects from the barrel after the exit of the bullet, due to the unique shape of the muzzle end of the cartridge.

I have named the new cartridge the "Self-Ejecting Muzzleloader Safety Cartridge" to put the emphasis on a key advantage to this new development. However, the cartridge has several other important advantages. It uses noncorrosive smokeless propellant, therefore eliminating one the biggest problems with the older type of propellants. It eliminates the problems with using the wrong volume of powder, since it is premeasured, and prepackaged. It loads faster. It can be marketed in a waterproof plastic wrapper, which eliminates moisture problems. It will also make it much easier for new shooters to purchase, and safely use a modern muzzleloader.

In the states which do not allow hunting with smokeless powder it would also be possible to load these cartridges with BlackHorn 209 or a similar Blackpowder substitute. This would make use of the other advantages of this device.

The weight of the bullet needs to be matched to the powder charge, in the same way that brass rifle cartridges are produced. Changing the weight of the bullet changes the pressure. The weight of the bullet will need to be matched to the propellant volume and burn rate. Upon ignition the hot gases from the burning propellant rupture the foil or thin plastic layer on the cone shaped end and allow the gases to pass through the central vent hole in this end of the cartridge. These gases will allow the sabot and cartridge to separate and operate independently of each other. Due to the size of the vent hole, plenty of pressure will still exist to push the cartridge out of the barrel.

Materials such as polymers might allow production of a perforated propellant capsule at lower cost, in the same way shotshells are now made up of some polymer materials. Steel cartridges could be coated with a thin layer of plastic to eliminate barrel wear and eliminate corrosion.

I claim:

1. A muzzleloader cartridge comprising:

a case having an open rear end, a forward end defining a vent hole, and sidewall defining a plurality of perforations;

the case defining an interior space;

a combustible liner lining the interior space;

a first propellant received in the interior space; and a second propellant having a different characteristic received in the interior space rearward of the first propellant, wherein the vent hole and the plurality of perforations are configured to vent gases produced by the first and second propellants during firing.

* * * * *